US006150773A

United States Patent [19]

Ribarich et al.

[11] Patent Number: 6,150,773

[45] Date of Patent: Nov. 21, 2000

[54] MODEL AND METHOD FOR HIGH-FREQUENCY ELECTRONIC BALLAST DESIGN

[75] Inventors: Thomas J. Ribarich, Laguna Beach; John J. Ribarich, Los Angeles; John E. Parry, Redondo Beach, all of Calif.

[73] Assignee: International Rectifier Corporation, El Segundo, Calif.

[21] Appl. No.: 09/337,757

[22] Filed: Jun. 22, 1999

[51] Int. Cl.[7] ..... G05F 1/00

[52] U.S. Cl. ..... 315/291; 315/307; 315/244; 315/209 R; 315/DIG. 7

[58] Field of Search ..... 315/291, 307, 315/308, 209 R, 244, 224, DIG. 4, DIG. 5, DIG. 7, 247

[56] References Cited

U.S. PATENT DOCUMENTS 5,426,350 6/1995 Lai ..... 315/244

6,031,342 2/2000 Ribarich et al. ..... 315/291

6,040,661 3/2000 Bogdan ..... 315/224

*Primary Examiner*—Haissa Philogene

*Attorney, Agent, or Firm*—Ostrolenk, Faber, Gerb & Soffen, LLP

[57] ABSTRACT

A model and computer program for designing the output stage of a high frequency electronic ballast for a fluorescent lamp. The user specifies a plurality of parameters relating to the operation of the fluorescent lamp, including lamp running power, running voltage, maximum preheating voltage for the lamp, minimum running frequency for the lamp, and an input voltage for the ballast. Based upon these parameters, the computer program calculates the values for various components of the ballast, including the inductor and capacitor of the output stage, such that the preheat frequency is greater than the ignition frequency, the ignition frequency is greater than or equal to the running frequency, the preheat voltage is less than the maximum preheat voltage, and the difference between the preheat frequency and the ignition frequency is greater than about 5 kHz.

5 Claims, 16 Drawing Sheets

1) Select Lamp And Specify $$P_{run},\ V_{run},\ V_{ph\,max},\ V_{ign\,max},\ I_{ign\,max}$$

2) Select $f_{run\,min}$ (>20kHz)

3) Select Vin

4) Calculate L

5) Calculate $f_{ph}$, $f_{ign}$, $f_{run}$, $V_{ph}$, $I_{ign}$

6) Select C Such That:

- $f_{ph} > f_{ign} \geq f_{run}$
- $V_{ph} < V_{ph\,max}$
- $f_{ph} - f_{ign} > 5kHz$
- $I_{ign} < I_{ign\,max}$ 1) Select Lamp And Specify $P_{run}$, $V_{run}$, $V_{ph\,max}$, $V_{ign\,max}$, $I_{ign\,max}$ 2) Select $f_{run\,min}$ (>20kHz)

3) Select Vin

4) Calculate L

5) Calculate $f_{ph}$, $f_{ign}$, $f_{run}$, $V_{ph}$, $I_{ign}$

6) Select C Such That:

- $f_{ph} > f_{ign} \geq f_{run}$
- $V_{ph} < V_{ph\,max}$
- $f_{ph} - f_{ign} > 5kHz$
- $I_{ign} < I_{ign\,max}$ IR2157 Bill of Materials File

Bill of Materials

| Qty | Manufacturer | Type | Part # | Description |
|---|---|---|---|---|
| 1 | International Rectifier | Bridge Rectifier | DF10S | Bridge Rectifier, 1A 1000V |
| 1 | Roederstein | Capacitor | F1772433-2200 | Capacitor, 0.33uF, 275VDC |
| 2 | Wima | Capacitor | MKP10 | Capacitor, 0..1uF, 400VDC |
| 2 | Panasonic | Capacitor | ECU-V1H103KBM | Capacitor, 0.01uF, SMT 1206 |
| 2 | Panasonic | Capacitor | ECJ-3YB1E474K | Capacitor, 0.47uF, SMT1206 |
| 5 | Panasonic | Capacitor | ECU-V1H104KBM | Capacitor, 0.01uF, SMT 1206 |
| 1 | Panasonic | Capacitor | EEU-EB2W100 | Capacitor, 10uF, 450VDC, 105C |
| 1 | Panasonic | Capacitor | EEU-FC1H4R7 | Capacitor, 4.7uF, 50VDC, 105C |
| 1 | Vitramon | Capacitor | 1812A152KXE | Capacitor, 1.5nF, 1KV, SMT 1812 |
| 1 | RG Allen | Capacitor | 1200PPJA103J09B | Capacitor, 0.01uF, 1200VDC, 5% tol. |
| 1 | Panasonic | Capacitor | ECU-V1H471KBM | Capacitor, 470pF, SMT 1206 |
| 3 | Diodes | Diode | LL4148 | Diode, 1N4148, SMT DL35 |
| 3 | International Rectifier | Diode | 10BF60 | Diode, SMT SMB |
| 1 | Motorola | IC | MC33262 | IC, Power Factor Controller |
| 1 | International Rectifier | IC | IR2157 | IC, Ballast Driver |
| 1 | Panasonic | EMI Inductor | ELF-15N007A | EMI Inductor, 1x10mH, 0.7Apk |
| 1 | RG Allen | PFC Inductor | RGA-EF25 | PFC Inductor, 1.0mH, 2.8a pk |
| 1 | RG Allen | Inductor | RGA-97408C | Inductor, 2.0mH, 2.0Apk |
| 3 | International Rectifier | Transistor | IRF830 | Transistor, MOSFET |
| 3 | Panasonic | Resistor | ERJ-8GEYJ680KV | Resistor, 680K ohm, SMT 1206 |
| 1 | Panasonic | Resistor | ERJ-8GEYJ7.5KV | Resistor, 7.5K ohm, SMT 1206 |
| 2 | Panasonic | Resistor | ERJ-8GEYJ820KV | Resistor, 820K ohm, SMT 1206 |
| 1 | Panasonic | Resistor | ERJ-8GEYJ10KV | Resistor, 10K ohm, SMT 1206 |
| 2 | Panasonic | Resistor | ERJ-8GEYJ100KV | resistor, 100K ohm, SMT 1206 |
| 3 | Panasonic | Resistor | ERJ-8GEYJ22V | Resistor, 22 ohm, SMT 1206 |
| 2 | Panasonic | Resistor | ERJ-8GEYJ22KV | Resistor, 24.9K ohm SMT 1206 |

Export Print Homepage

FIG.15

MODEL AND METHOD FOR HIGH-FREQUENCY ELECTRONIC BALLAST DESIGN

BACKGROUND OF THE INVENTION

1. Field of the Invention

The invention relates to a model and method for designing the output stage of an electronic ballast using a computer.

2. Description of the Related Art

As shown in FIG. 1, present day electronic ballasts include circuitry for filtering electromagnetic interference (EMI) to block ballast generated noise, power factor correction (PFC) circuitry for sinusoidal input current, undervoltage lockout (UVLO) and fault protection circuitry, a half-bridge switch with driver and timing circuitry for high-frequency operation, and a final output stage to power the lamp.

FIG. 2 shows a simplified model of the output stage of a typical fluorescent lamp circuit. The lamp requires a current for a specified time to preheat the filaments, a high-voltage for ignition, and running power. These requirements are satisfied by changing the frequency of the input voltage and properly selecting $V_{in}$, L and C. For preheat and ignition, the lamp is not conducting and the circuit is a series L-C. During running, the lamp is conducting, and the circuit is an L in series with a parallel R-C.

The magnitude of the transfer function (lamp voltage divided by input voltage) for the two RCL circuit configurations, shown in FIG. 3, illustrates the operating characteristics for this design approach. The currents and voltages corresponding to the resulting operating frequencies determine the maximum current and voltage ratings for the inductor, capacitor and the switches which, in turn, directly determine the size and cost of the ballast.

It would be desirable to provide a computer program for automatically designing the output stage and specifying the values of various components of an electronic ballast, such as the inductor and capacitor of the output stage, based on certain parameters specified by the user.

SUMMARY OF THE INVENTION

The present invention provides a model for the designing a high frequency electronic ballast and a method, in the form of a computer program, for implementing the model.

More specifically, the computer program of the present invention carries out a method for designing the output stage of an electronic ballast for a fluorescent lamp, by the following steps:

1. The user first specifies a plurality of parameters relating to the operation of the fluorescent lamp, including a running power, a running voltage, and a maximum preheating voltage for the lamp;
2. The user selects a minimum running frequency for the lamp;
3. The user selects an input voltage for the ballast;
4. The program calculates the value for the inductor of the output stage;
5. The program calculates the preheat frequency, the ignition frequency, the running frequency, the preheat voltage, and the ignition current; and
6. The program calculates a value for the capacitor of the output stage, such that the preheat frequency is greater than the ignition frequency, the ignition frequency is greater than or equal to the running frequency, the preheat voltage is less than the maximum preheat voltage, and the difference between the preheat frequency and the ignition frequency is greater than about 5 kHz.

Other features and advantages of the present invention will become apparent when the following description of the invention is read in conjunction with the accompanying drawings.

BRIEF DESCRIPTION OF THE DRAWINGS

FIG. 15 is a bill of materials generated by the computer program of the present invention.

DETAILED DESCRIPTION OF THE PREFERRED EMBODIMENTS

Figure 1:
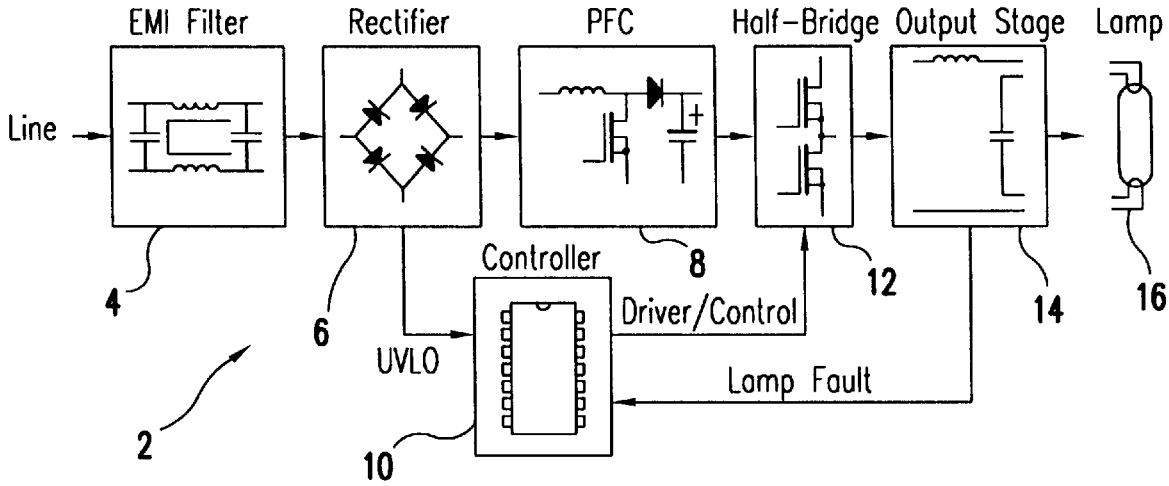
FIG.1 PRIOR ART
FIG. 1 shows a ballast functional block diagram.

Referring to FIG. 1, a prior art electronic ballast 2 is shown schematically as a functional block diagram. Ballast 2 includes an electromagnetic interference (EMI) filtering section 4 to block ballast generated noise. Line voltage is converted to DC by rectifier 6. Power factor correction (PFC) section 8 adjusts for sinusoidal input current. Undervoltage lockout (UVLO) and fault protection are provided by controller 10, and half-bridge switches 12 are driven and timed for high-frequency operation. A final output stage 14 powers the lamp 16.

Figure 2:
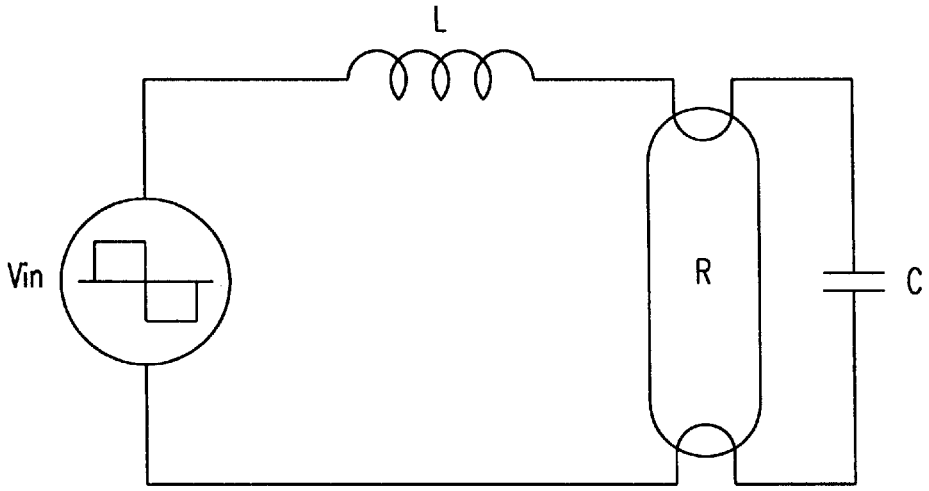
FIG.2 PRIOR ART
FIG. 2 shows a simplified model of the output stage of a typical electronic ballast.

A simplified circuit representation of the output stage of a typical electronic ballast circuit is shown in FIG. 2. The actual ballast circuit supplies lamp current to preheat the filaments, a high-voltage for ignition, and running power. These requirements are satisfied by changing the frequency of the input voltage and properly selecting $V_{in}$, L and C. For preheat and ignition, the lamp is not conducting and the circuit is a series L-C. During running, the lamp is conducting, and the circuit is an L in series with a parallel R-C.

The model of the present invention consists of a set of equations for each operating frequency and the corresponding lamp voltage and circuit currents. These operating frequencies are a function of L, C, input voltage, filament pre-heat current, ignition voltage, lamp running voltage and power. During preheat, the resistance of the lamp is assumed to be infinite and the filament resistance negligible, resulting in an L-C series circuit. Using the impedance across the capacitor, the preheat frequency is:

$$f_{ph} = \frac{I_{ph}\sqrt{2}}{2\pi C V_{ph}} \quad \text{[Hz]} \tag{1}$$

and the transfer function is:

$$\frac{V_{ph}}{\frac{4V_{in}}{\pi}} = \frac{1}{|1 - 4LC\pi^2 f_{ph}^2|} \tag{2}$$

Solving (1) and (2) simultaneously yields, $$Vph = -\frac{V_{in}}{\pi} + \sqrt{\left(\frac{V_{in}}{\pi}\right)^2 + \frac{L}{C} I_{ph}^2} \tag{3}$$

where, $V_{in}$=Input square wave voltage [Volts]

$V_{ph}$=Lamp preheat voltage amplitude [Volts]

$I_{ph}$=Filament preheat current amplitude [Amps]

L=Output stage inductor [Henries]

C=Output stage capacitor [Farads]

Note that the linear analysis uses the fundamental frequency of the squarewave produced by the half-bridge switches. Higher harmonics are assumed negligible and the practical implementation of the squarewave which includes switching deadtime, current circulation paths and snubbing has been considered in selecting the fundamental frequency for the model.

During ignition, the frequency for a given ignition voltage can be found using (2), since the lamp is still an open circuit, $$f_{ign} = \frac{1}{2\pi}\sqrt{\frac{1 + \frac{4}{\pi}V_{in}}{\frac{V_{ign}}{LC}}} \quad \text{[Hz]} \tag{4}$$

where, $V_{ign}$=Lamp ignition voltage amplitude [Volts]

The associated peak ignition current flowing in the circuit that determines the maximum current ratings for the L and half-bridge switches, becomes:

$$I_{ign} = f_{ign} C V_{ign} 2\pi \text{[Amps]} \tag{5}$$

Once the lamp has ignited, the resistance of the lamp is no longer negligible, and the system becomes a low-Q RCL series-parallel circuit with a transfer function, $$\frac{V_{run}}{\frac{4V_{in}}{\pi}} = \frac{1}{\sqrt{(1 - LC\omega^2)^2 + \frac{L^2}{R^2}\omega^2}} \tag{6}$$

The running frequency [Hz] becomes:

$$f_{run} = \frac{1}{2\pi}\sqrt{\frac{1}{LC} - 2\left(\frac{P_{run}}{CV_{run}^2}\right)^2 + \sqrt{\left[\frac{1}{LC} - 2\left(\frac{P_{run}}{CV_{run}^2}\right)^2\right]^2 - \frac{1 - \left(\frac{4V_{in}}{V_{run}\pi}\right)^2}{L^2C^2}}} \tag{7}$$

whose R is the linearized lamp resistance determined from the running lamp power and voltage:

$$R = \frac{V_{run}^2}{2P_{run}} \tag{8}$$

where, $P_{run}$=Lamp running power [W]

$V_{run}$=Lamp running voltage amplitude [Volts]

EXAMPLE

1. Lamp requirements:

The model of the present invention is used to design a ballast for a 36 W/T8 linear lamp based on the following lamp requirements. For preheat, a current must be defined which adequately heats the lamp filaments to their correct emission temperature within a defined time. The series connection of the lamp filaments with the capacitor defines the preheat mode as current-controlled. The model therefore calls for a constant current flowing through the filaments as opposed to a constant voltage over the filaments as in voltage-controlled preheat mode. Because of the lamp life sensitivity to preheat current, this value is not commonly listed in the lamp manufacturer's data sheet.

Because of tolerances from lamp to lamp and differences in the electron-emitting filament coating mix from manufacturer to manufacturer for the same lamp type, it is recommended that the designer choose the preheat current experimentally and verify it over all lamp manufacturers with lamp life switching cycle tests. A preheat current of:

$I_{ph}$(rms)=0.6 Amps was chosen for the 36 W/T8 linear lamp which heats the filaments to a warm to cold resistance ratio of 3:1 in 2.0 seconds.

The maximum allowable voltage over the lamp during preheat, or, the minimum voltage required to ignite the lamp was experimentally determined as:

$V_{ph}$pk-to-pk=600 Volts.

This voltage is a function of ambient temperature, frequency and distance from the lamp to the nearest earth plane (usually the fixture). Should the lamp voltage exceed this value during preheat, the lamp can ignite before the filaments have been sufficiently heated, affecting the life of the lamp.

During ignition, the minimum voltage required to ignite the lamp has been experimentally determined as:

$V_{ign}$pk-to-pk=1100 Volts.

This voltage increases with decreasing ambient temperature and/or sufficient preheating, and increases with increasing distance from the lamp to the nearest earth plane.

Finally, during running, the recommended lamp power and voltage at high-frequency are:

$P_{run}$=32 W, and $V_{run}$=100 Volts·√2=141 Volts.

With each operating point now bounded for the given lamp type, the model can be used to calculate component values and frequencies.

2. Ballast Design

Figure 4:
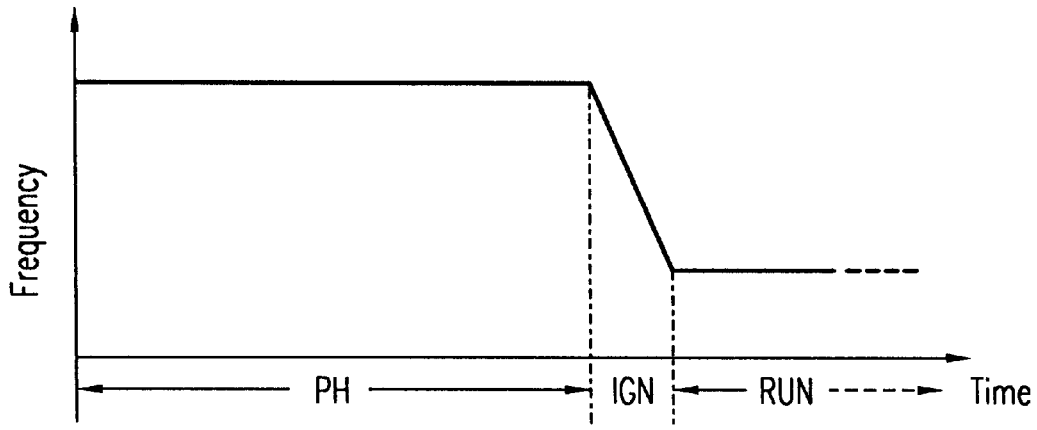
FIG.4 PRIOR ART
FIG. 4 shows a typical open-loop ballast control sequence.

A fully functional electronic ballast for a ballast controller IC applications kit (FIG. 1) was designed, built and tested for performance. The input stage was designed for universal input, high PF and low total harmonic distortion (THD) using an active PFC IC. The International Rectifier ballast controller IC, IR2157, was used to program the operating frequencies. The IR2157 provides a flexible control sequence, a typical example of which is shown in FIG. 4, for the preheat time and a smooth transition to each operating point, as well as over-current protection against failure to strike and lamp presence detection for open-filament protection or lamp removal.

Figure 5:
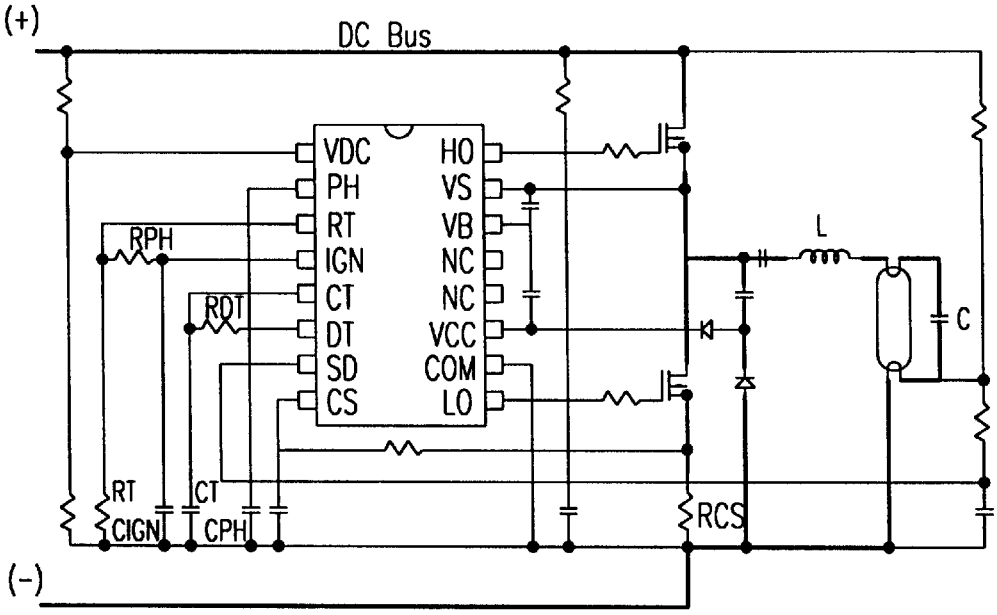
FIG.5 PRIOR ART
FIG. 5 shows a typically connection diagram of for the IR2157 ballast driver IC.

The model of the present invention was used to choose the L, C, and frequencies of the output stage for a 36 W/T8 lamp and those parameters were used to select the programmable inputs of the IR2157 ballast controller IC, which is disclosed in U.S. application Ser. No. 09/225,635, filed Jan. 10, 1999, the disclosure of which is herein incorporated by reference. A typical connection diagram for the IR2157 ballast controller IC is shown in FIG. 5.

The first step is to calculate an L based on the power in the lamp during running. For an optimum transfer of energy to the low-Q RCL circuit, an optimal dimensioning of L and C would set their physical size to just match the maximum power requirement. This occurs at the resonant frequency of the overdamped circuit, assuming half of the available input voltage to the output stage to be over L, where the output stage input power is:

$$P_{in} = \frac{4V_{in}}{\sqrt{2}\,\pi} I_{in} = \frac{4V_{in}}{\sqrt{2}\,\pi}\left(\frac{V_{in}}{2L\omega}\right) = \frac{P_{run}}{\eta} \quad \text{[W]} \tag{9}$$

The output stage efficiency, η, takes into account switching and conductive losses in the half-bridge switches, and resistive losses in L and the filaments. Solving for L as a function of lamp power yields:

$$L = \frac{V_{in}^2 \eta}{f_{run}\sqrt{2}\,\pi^2 P_{run}} \quad \text{[Henries]} \tag{10}$$

Selecting a reasonable running frequency of about 35 kHz, an efficiency of 0.95 and setting the DC bus to 400 VDC for universal input ($V_{in}$=200 V), gives an L=2.5 mH for a lamp power of 32 W. How good this value is for L depends on the dimensioning of C and how well the other operating conditions are fulfilled.

Figure 6:
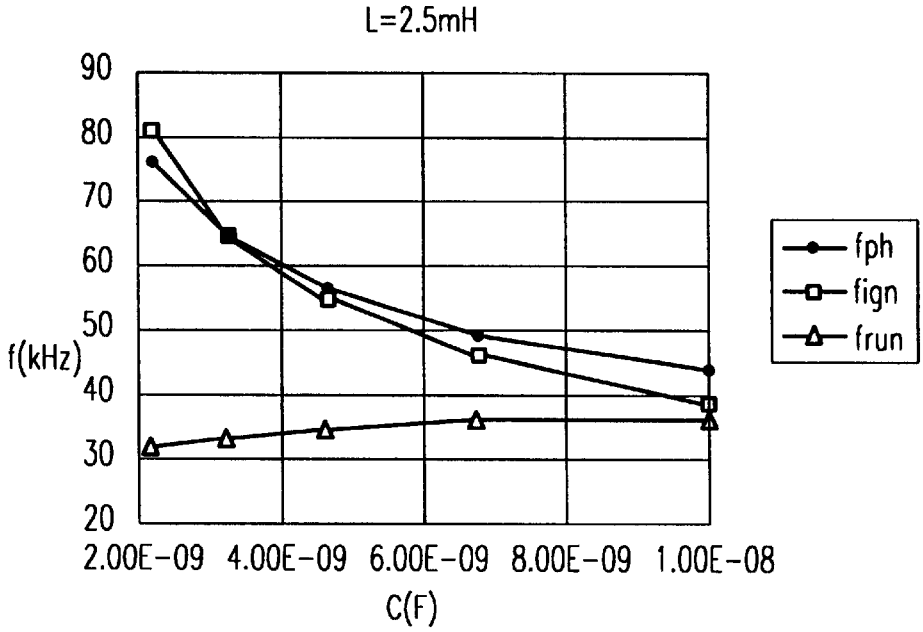
FIG. 6 shows a plot of a set of curves for frequency vs. C for the preheat, ignition and running operating points of a 36 W/T8 fluorescent lamp.

To select C, the model of the present invention was used to generate a set of curves for frequency versus C for the preheat, ignition and running operating points, as shown in FIG. 6. Using the open-loop control sequence of the IR2157 (see FIG. 4), starting at the preheat frequency for the duration of the preheat time and then ramping down through the ignition frequency to the run frequency, places a design constraint on the values for L and C of:

$f_{ph} > f_{ign} \geqq f_{run}$

From the plot shown in FIG. 6, it can be seen that there exist several values of C which fulfill the control sequence constraint, however, the lower the value of C, the narrower the range of frequency between preheat and ignition. These narrow ranges may give tolerance problems during production. A higher C value such as 10 nF gives a larger frequency range between operating points. Another trade-off associated with C is that the higher the C value, the lower the lamp voltage during preheat, but the ignition current associated with the defined worst-case ignition voltage increases. All of these parameters should be carefully checked with each new L and C combination, as summarized in the chart of FIG. 7, consisting of six design steps for the selection procedure.

With a chosen L and C of 2.5 mH and 10 nF, and the operating frequencies calculated, the corresponding programmable inputs of the IR2157 are calculated with the following design equations:

$$R_T = \frac{1.33}{C_T}\left(\frac{1}{2f_{run}} - 0.56 \cdot R_{DT} \cdot C_T\right) \quad \text{[Ohms]} \tag{11}$$

$$C_{PH} = \frac{t_{ph}}{5.15E6} \quad \text{[Farads]} \tag{12}$$

$$R_{PH} = \frac{\frac{1.33}{C_T}\left(\frac{1}{2f_{ph}} - 0.56 \cdot R_{DT} \cdot C_T\right)}{1 - \frac{1.33}{R_T C_T}\left(\frac{1}{2f_{ph}} - 0.56 \cdot R_{DT} \cdot C_T\right)} \quad \text{[Ohms]} \tag{13}$$

$$R_{DT} = \frac{1.79 t_{deadtime}}{C_T} \quad \text{[Ohms]} \tag{14}$$

$$C_{IGN} = \frac{t_{ign}}{3R_{PH}} \quad \text{[Farads]} \tag{15}$$

$$R_{CS} = \frac{1.0}{I_{ign}} \quad \text{[Ohms]} \tag{16}$$

Choosing $t_{ph}$=2.0 s, $t_{deadtime}$=1.2 E−6 s, $t_{ign}$=0.05 s and $C_T$=1 E−9 F, yields $R_{DT}$=2000 Ω, $R_T$=20000 Ω, $R_{PH}$=56000 Ω, $R_{CS}$=0.8 Ω, $C_{PH}$=470 E−9 F and $C_{IGN}$=330 E−9 F. All other diodes, capacitors and resistors shown in the circuit diagram of FIG. 5 are needed for such standard functions as IC power-up, snubbing, bootstrapping and DC blocking.

Figure 3:
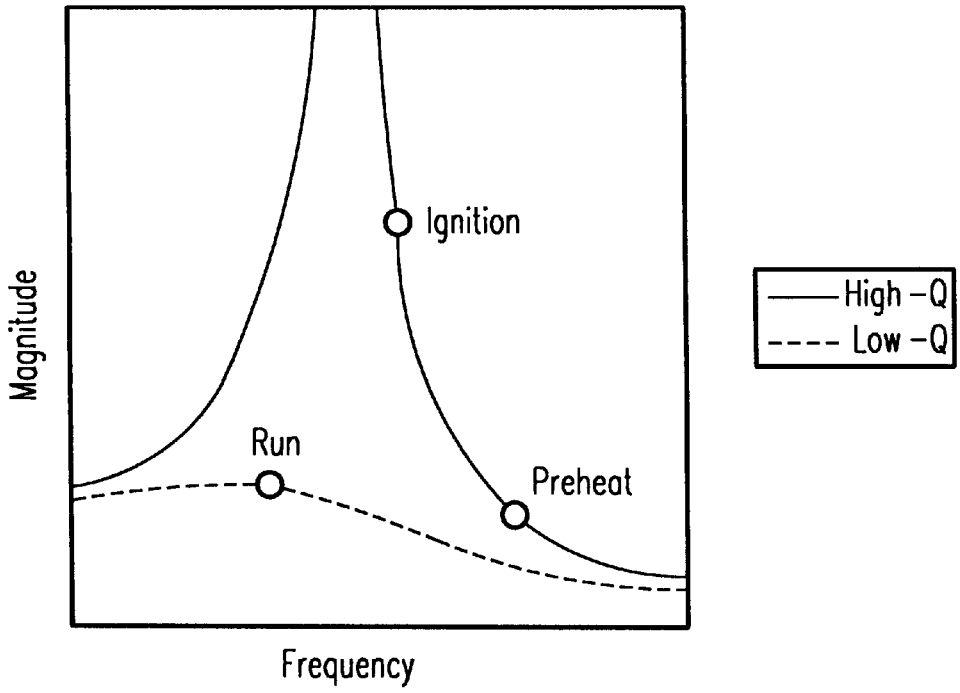
FIG.3 PRIOR ART
FIG. 3 shows the transfer function of an RCL circuit with typical operating points.
Figures 7, 8:
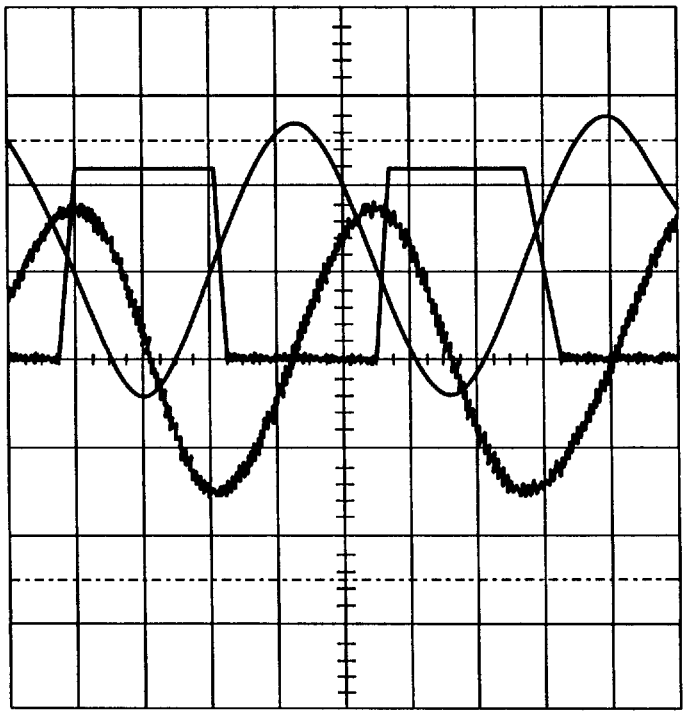
FIG. 7 is a chart showing a summary of the design steps for selecting the values of L and C of the output stage of a fluorescent lamp.
FIGS. 8, 9 and 10 show the operating frequency, the lamp voltage, and the inductor current for preheat, ignition, and running conditions, respectively, of an electronic ballast circuit designed in accordance with the present invention.
Figure 9:
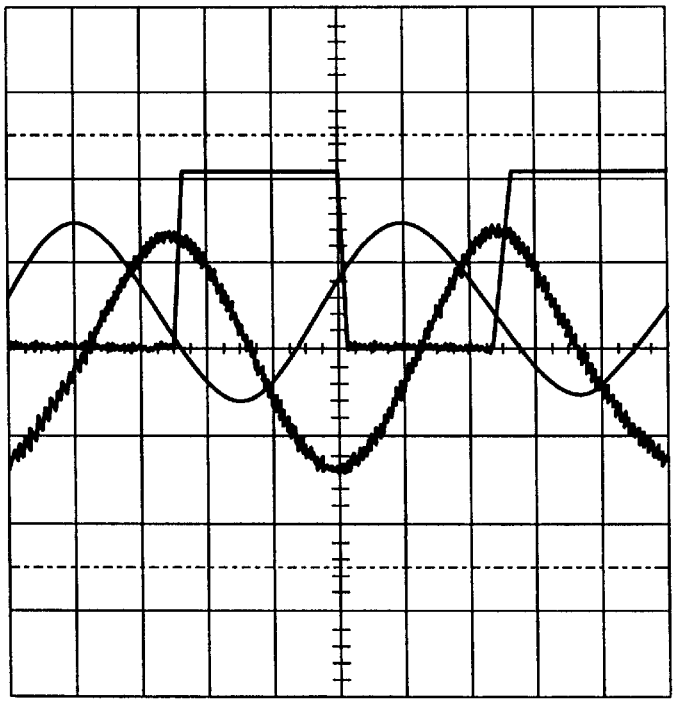
Figure 10:
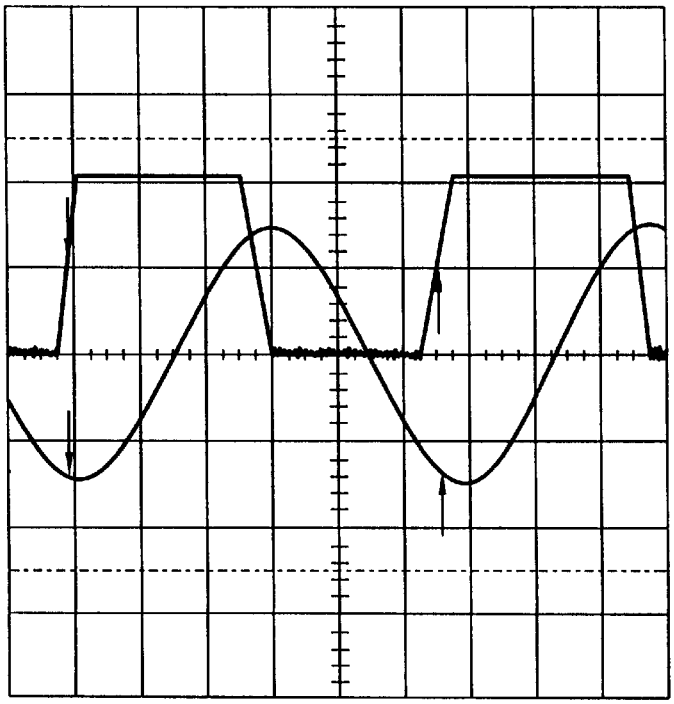

A breadboard incorporating the above values was constructed and its performance measured and compared with the predicted model values. FIGS. 8, 9 and 10 show operating frequency, lamp voltage and inductor current for preheat, ignition and running conditions, respectively. During preheat and ignition, the voltage and current waveforms are sinusoidal, while during running, the effects of the non-linear resistance of the lamp can be seen on the lamp voltage. To obtain the maximum ignition voltage and current (FIG. 9), the lamp was removed and substitute filament resistors were inserted to simulate a deactivated lamp. This allows the frequency to ramp down from preheat to ignition along the high-Q transfer function (FIG. 3) until the current limit of the IR2157 is reached and the half-bridge switches turn off.

The measured and predicted frequencies match within 3% (see Table 1 below), while other lamp types and component selections can deviate as much as 10%. Such deviations are expected due to the neglected harmonics, non-linear lamp resistance, and tolerances in lamp manufacturing, Vin, L and C. Another iteration in the component selection process may be necessary.

TABLE 1 predicted and measured values for F36T8 ballast output stage.

| Parameter | Model | Measured |
|---|---|---|
| $f_{ph}$ | 42.8 kHz | 42.6 kHz |
| $f_{iqn}$ | 38.5 kHz | 38.8 kHz |
| $f_{run}$ | 35.3 kHz | 34.4 kHz |
| $v_{ph_{pk\text{-}to\text{-}pk}}$ | 632 V | 625 V |
| $i_{ign_{pk}}$ | 1.5 A | 1.2 A |

An actual production ballast was constructed using the above approach, and the output stage was dimensioned for dual lamp series operation. Temperature, lifetime, performance margins, packaging, layout, manufacturability and cost were all considered during the design process.

In conclusion, the model of the present invention yields good results in predicting the operating points for several different lamp types ranging in both geometry (linear and compact types) and power. The present invention greatly reduces the time needed to dimension the ballast for different lamp types on the market and is an effective and useful tool for optimizing ballast size and cost. The present invention also helps to reduce ballast product families and increase manufacturability.

Computer Program

Figure 11:
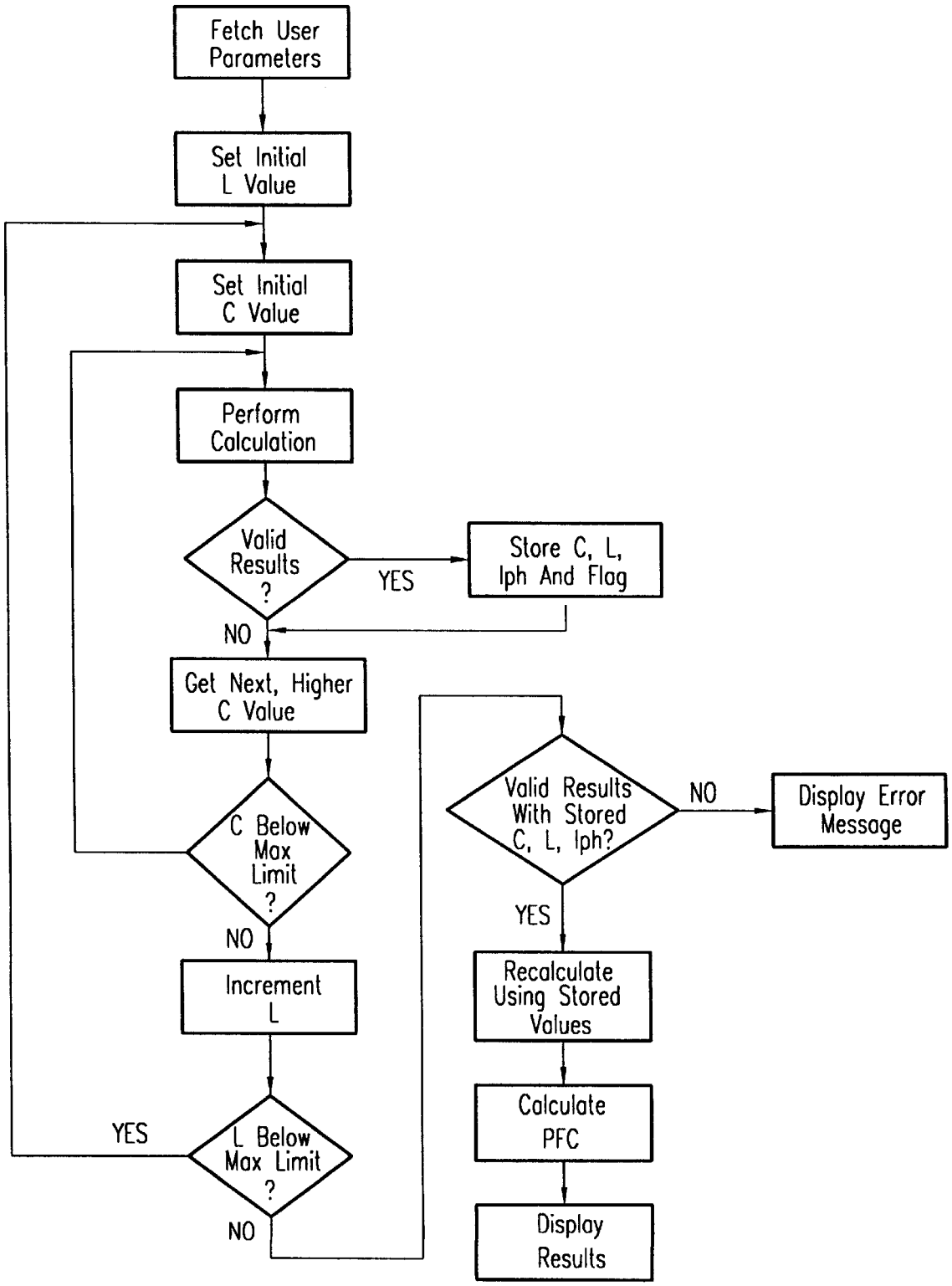
FIG. 11 is a flowchart of a computer program that implements the model of the present invention.

A computer program for implementing the model of the present invention is represented by the flowchart shown in FIG. 11. The steps of the program are outlined as follows:

```
The main calculation function: Accepts a value for L, C and
I_preheat (The 3 variables as discussed above originally being
cycled). The rest have already been set from the user parameters.
It performs the calculation, returning a value, depending on its
success.
NO_SOLUTION (Calculation finished OK, but no acceptable result)
FINISHED_OK (Calculation finished OK, acceptable result)
CALCULATION_ABORTED (Calculation aborted due to error, divide by
zero, etc.)
The calling routine (shown in the flowchart), remembers the values
for L, C and Iph, if the function returns a FINISHED_OK, the result
is an acceptable value from the highest L (main priority), then the
highest C (lower priority)
An acceptable result is defined as:
f_ph - f_ign >= 5 Khz, <= 10 Khz
v_ph < v_phmax
f_run >= f_runmin
The equation functions, as discussed above, are given below
' Set up error handler.
On Error GoTo ErrorHandler
' Set to fail by default
calculate_single = CALCULATION_NO_SOLUTION
' Do calculation
V_preheat = calculate_V_Preheat(DC_bus_preheat, L, C, I_preheat)
f_preheat = calculate_f_preheat(I_preheat, C, V_preheat)
f_ign = calculate_f_ign(DC_bus_run / 2, V_ignmax, L, C)
R_run = calculate_R_run(V_run, P_run)
f_run = calculate_f_run(L, C, R_run, DC_bus_run / 2, V_run)
I_ign = calculate_I_ign(f_ign, C, V_ignmax)
f_res = calculate_resonance(C, L)
preheat_gap = f_preheat - f_ign
' Finished OK. Check for acceptable result
If (preheat_gap >= preheat_frequency_gap_min And preheat_gap <=
preheat_frequency_gap_max) Then
    If V_preheat < V_preheatmax Then
        If f_run >= f_runmin Then
            calculate_single = CALCULATION_FINISHED_OK
        End If
    End If
End If
' Error trap
ErrorHandler:
    ' Set return flag to aborted
    calculate_single = CALCULATION_ABORTED
Equation 1
Calculate_f_preheat(Iph As Double, C As Double, Vph As Double) As
Double
    calculate_f_preheat = Iph * 1.414 / (Vph * C * 2 * pi)
End Function
Equation 3
Use VDCBUSph as 1st parameter (replacing Vin).
Calculate_V_Preheat(DC_bus_preheat As Double, L As Double, C As
Double, Iph As Double) As Double
Dim e1 As Double, e2 As Double, e3 As Double
    e1 = 2 * (L / C) * (Iph ^ 2)
    e2 = (DC_bus_preheat / pi) ^ 2
    e3 = - (DC_bus_preheat / pi)
    calculate_V_Preheat = e3 + (Sqr((e2 + e1)))
```

-continued

```
End Function
Equation 4
Calculate_f_ign(Vin As Double, Vign As Double, L As Double, C As
Double) As Double
Dim top As Double
Dim bottom As Double
    top = 1 + (((4 / pi) * Vin) / Vign)
    bottom = (L * C)
    calculate_f_ign = (Sqr(top / bottom)) / (2 * pi)
End Function
Equation 5
Function: calculate_I_ign(f_ign As Double, C As Double, Vignmax As
Double) As Double
    calculate_I_ign = f_ign * C * Vignmax * 2 * pi
End Function
Equation 7
Function: calculate_f_run(L As Double, C As Double, R As Double,
Vin As Double, Vrun As Double) As Double
Dim e1 As Double, e2 As Double, e3 As Double, e4 As Double, e5 As
Double, e6 As Double, e7 As Double
    e1 = 1 - (((4 * Vin) / (Vrun * pi)) ^ 2)
    e2 = (L ^ 2) * (C ^ 2)
    e3 = - (e1 / e2)
    e4 = ((1 / (L * C)) - (1 / (2 * (R ^ 2) * (C ^ 2)))) ^ 2
    e5 = Sqr((e4 + e3))
    e6 = (1 / (L * C)) - (1 / (2 * (R ^ 2) * (C ^ 2)))
    e7 = Sqr((e6 + e5))
    calculate_f_run = e7 / (2 * pi)
End Function
Equation 8
Function: calculate_R_run(V_run As Double, P_run As Double) As
Double
    Calculate_R_run = (V_run ^ 2) / (2 * P_run)
End Function
Equation 10
Function: calculate_L(Vin As Double, eff As Double, Frun As Double,
Prun As Double) As Double
    calculate_L = ((Vin ^ 2) * eff) / ((Frun * Sqr(2) * (pi ^ 2) *
Prun))
End Function
```

An example of an implementation of a computer program according to the present invention is shown in FIGS. 12–20. The program is installed to the computer such that program instructions are loaded into a memory or other means whereby the program instructions can be carried out, and results displayed by the computer. The program preferably is implemented on a personal computer or on a distributed platform, such as local and wide-area networks, or the Internet. The program is accessed by a designer or manufacturer using a keyboard and mouse, for example, or other input devices. The information and input screens generated by the programmed computer typically are displayed on a video monitor or other type of graphical user interface.

Figure 12:
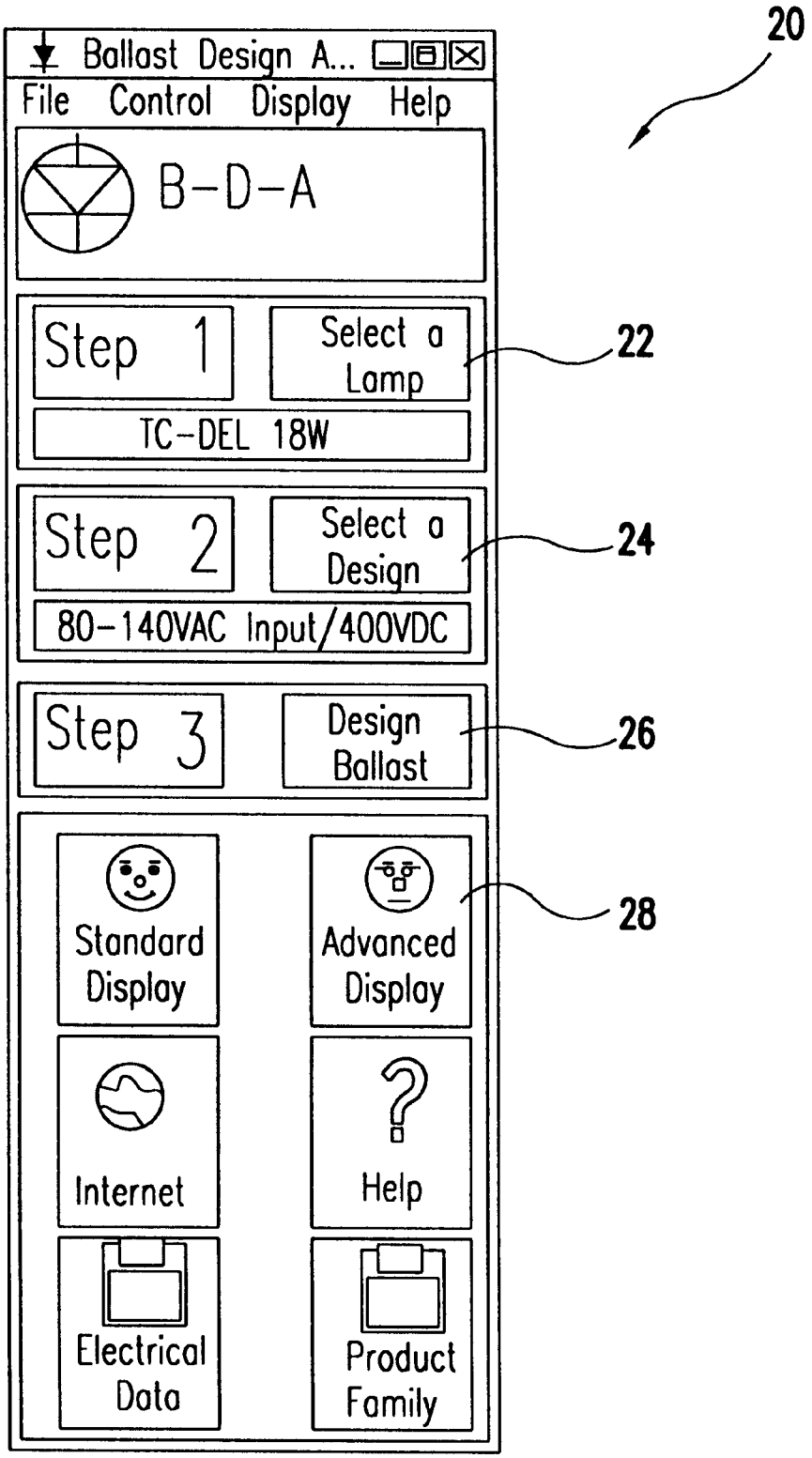
FIG. 12 is a standard display screen of a ballast design computer program according to the present invention.

Referring to FIG. 12, an initial standard screen 20 for the computerized ballast design assistant of the present invention is shown. The standard screen 20 presents the user with three basic steps to follow in the initial design of a ballast. Various optional functions also are provided, in addition to the typical file access functions generally provided by existing computer operating systems.

Icons for selecting the basic design steps include a lamp selection icon 22 ("Select a Lamp"), a design selection icon 24 ("Select a Design"), and a ballast design icon 26 ("Design Ballast"). In addition, the user can select an advanced display icon 28, obtain help, electrical data, product family data, etc.

Figure 13:
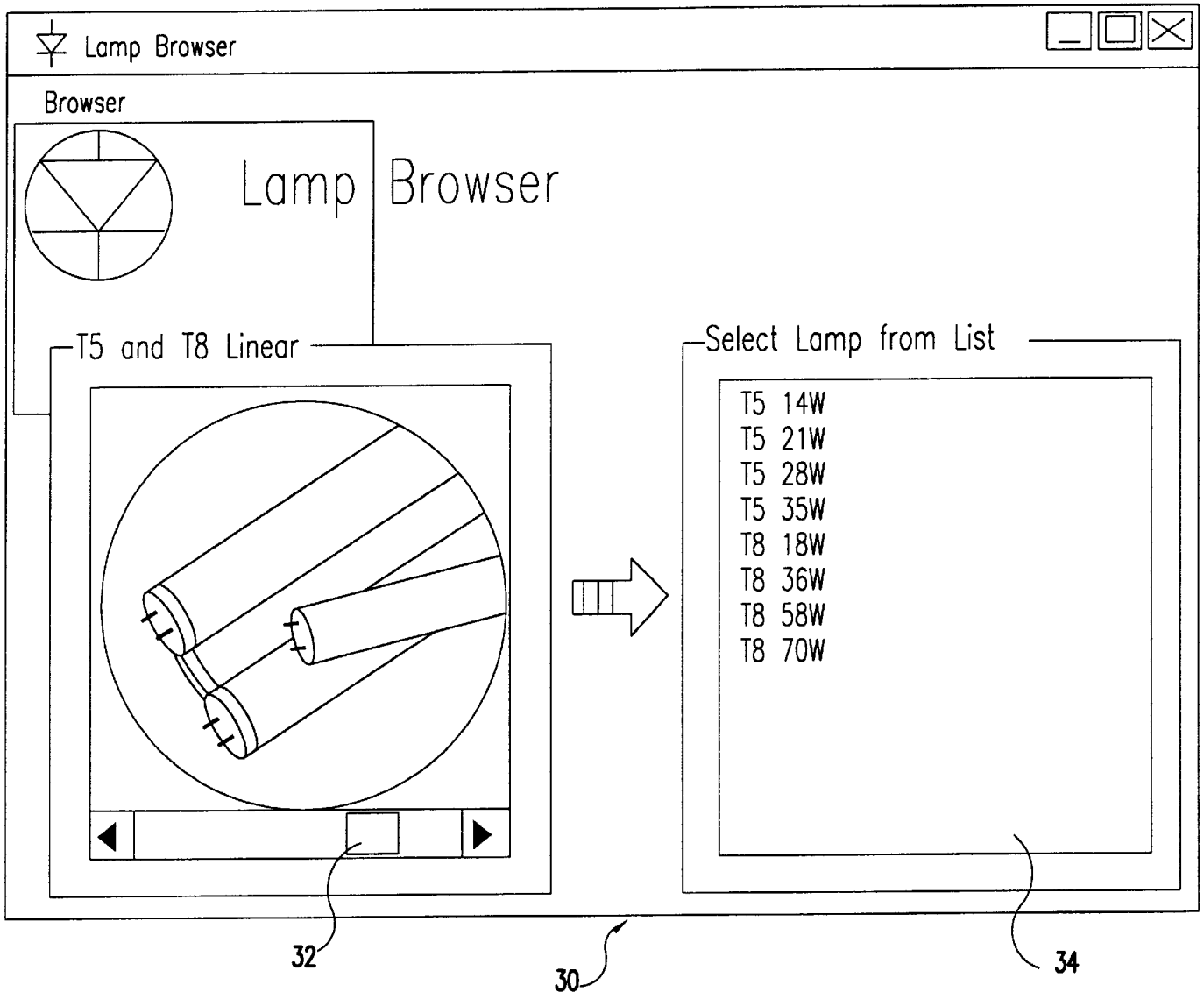
FIG. 13 is a lamp browser of the computer program of the present invention.

By engaging the lamp selection icon 22, a lamp browser 30 is displayed as shown in FIG. 13. By manipulating a slide bar 32 below a lamp display 34, the user can select from various types of lamps stored in or accessible by the programmed computer, including TC-DEL, triple, PL-L, TC-EL, and TS and T8 linear, for example.

Each type of bulb is provided in a standard range of size and wattage, as listed in lamp selection window 36. Operating parameters for each lamp are provided in a look-up table that is stored in, or made available to, the computer by the ballast design program.

Once the user selects a lamp, the lamp type is entered on the standard display screen 20 and step 1 is complete. Based on the selected lamp, a user-modifiable default minimum value for the run frequency is supplied by the program. The operating parameters of the lamp, as discussed above, accordingly are made available to the computer program implementing the model equations for use in calculating an optimal ballast design.

Figure 14:
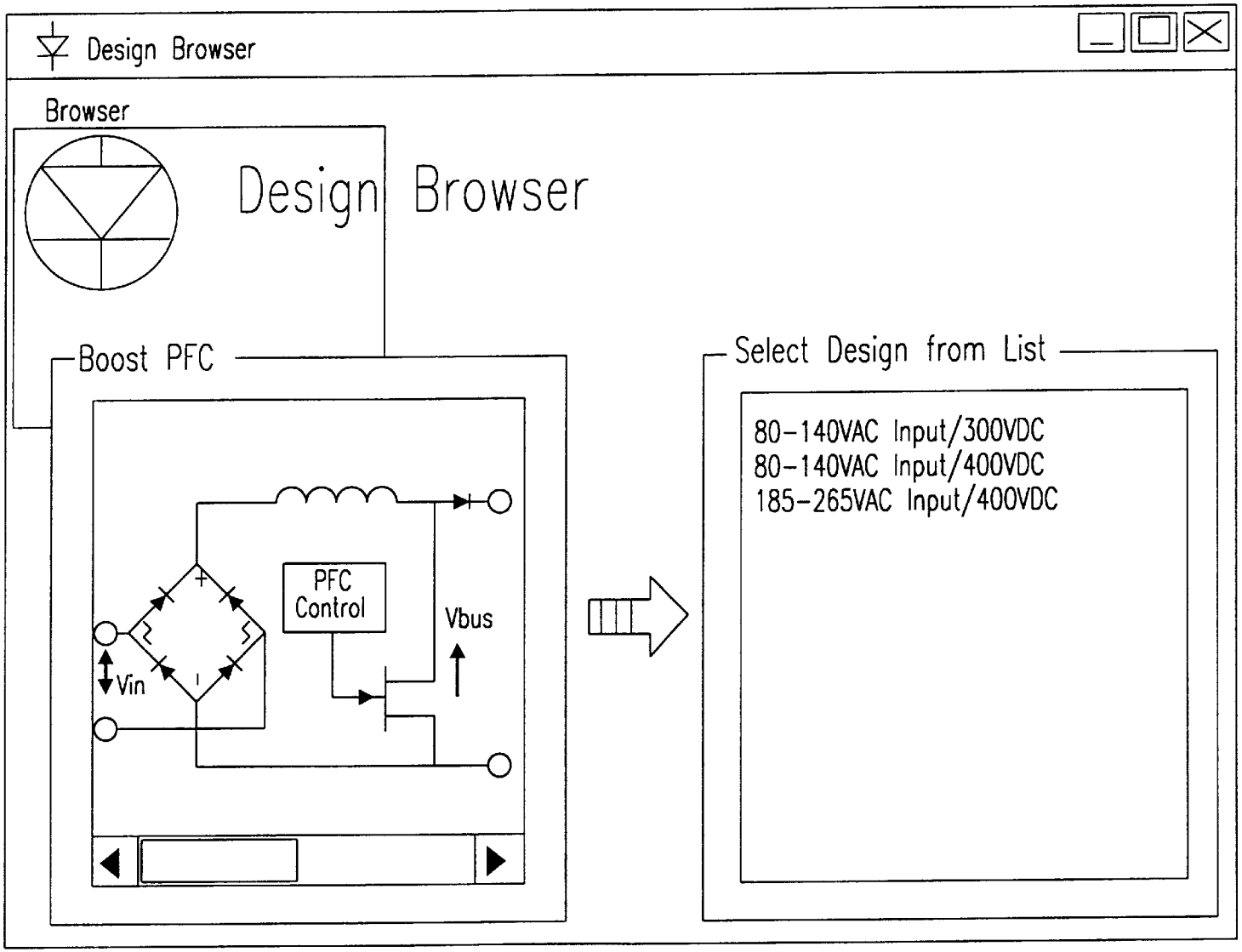
FIG. 14 is a design browser of the computer program of the present invention.

In step 2, the user opens a design browser using the design selection icon 24. The design browser, as shown in FIG. 14, allows the user to select a ballast type and operating parameters, such as input voltage, from those available. Based on the selected ballast type, the computer program provides access to a stored database of ballast information and operating parameters. The operating parameters of the selected ballast then are supplied for use by the model discussed above in calculating the appropriate design for the ballast.

Figure 16A:
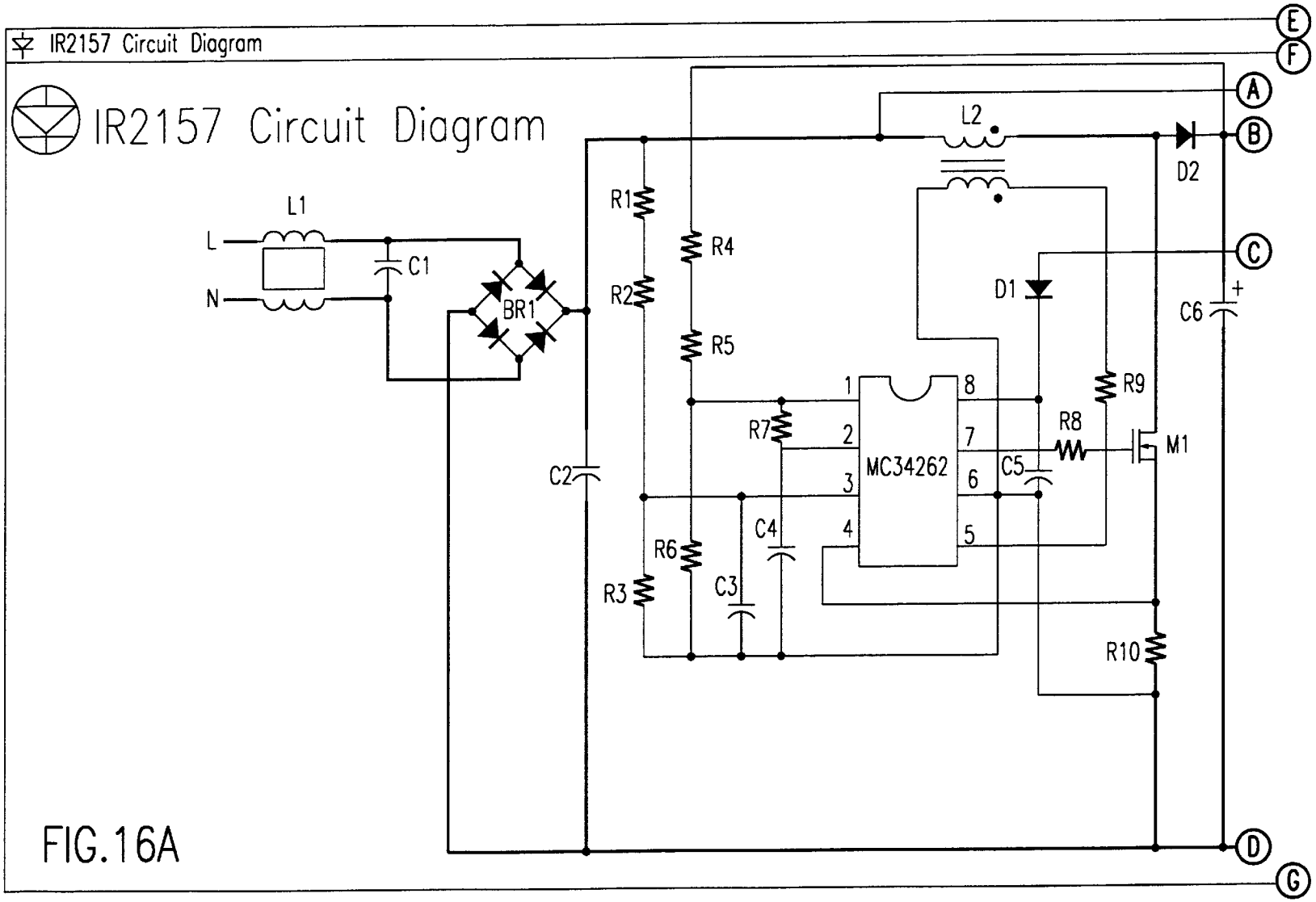
FIG. 16 is a circuit diagram generated by the computer program of the present invention.
Figure 16B:
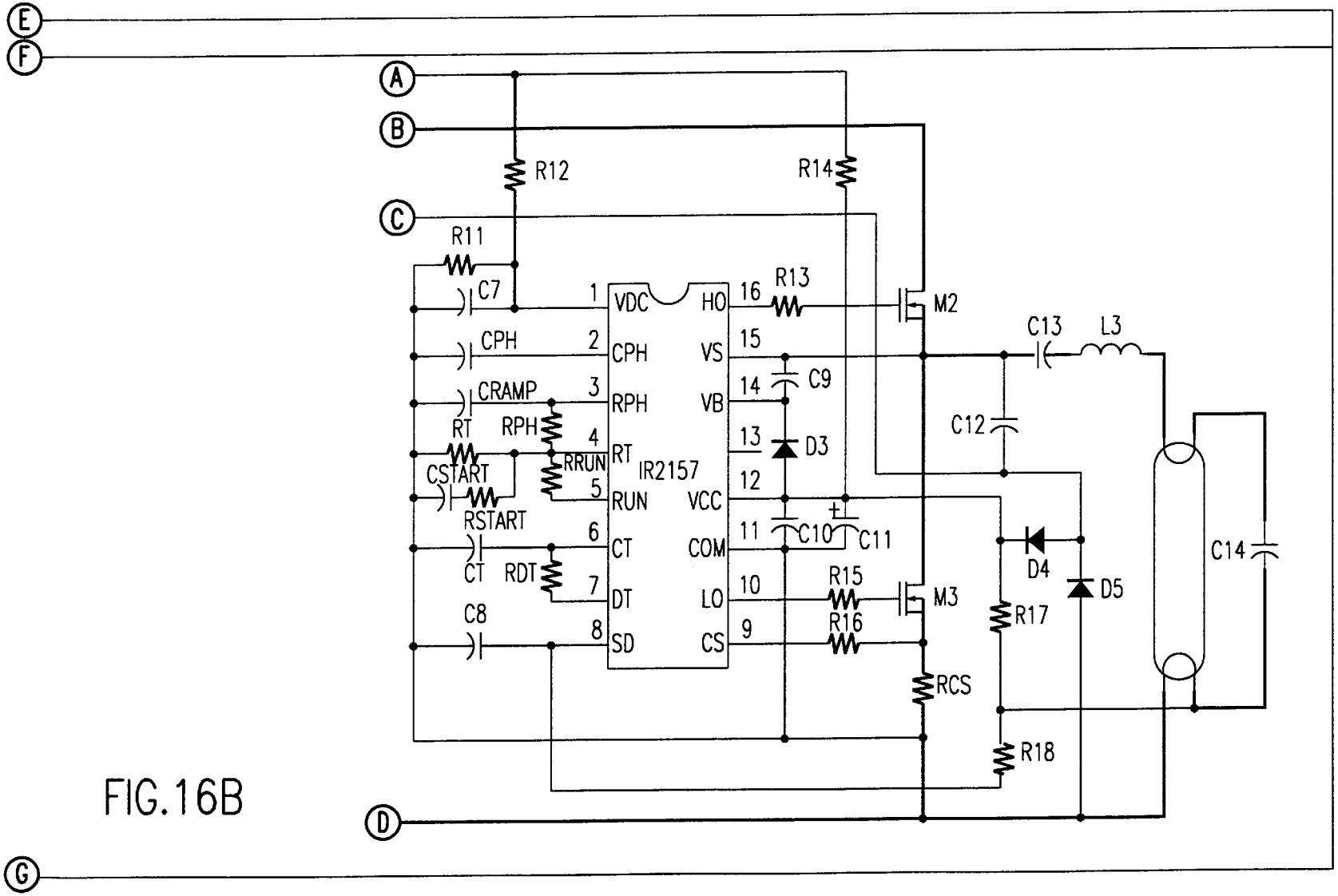
Figure 17:
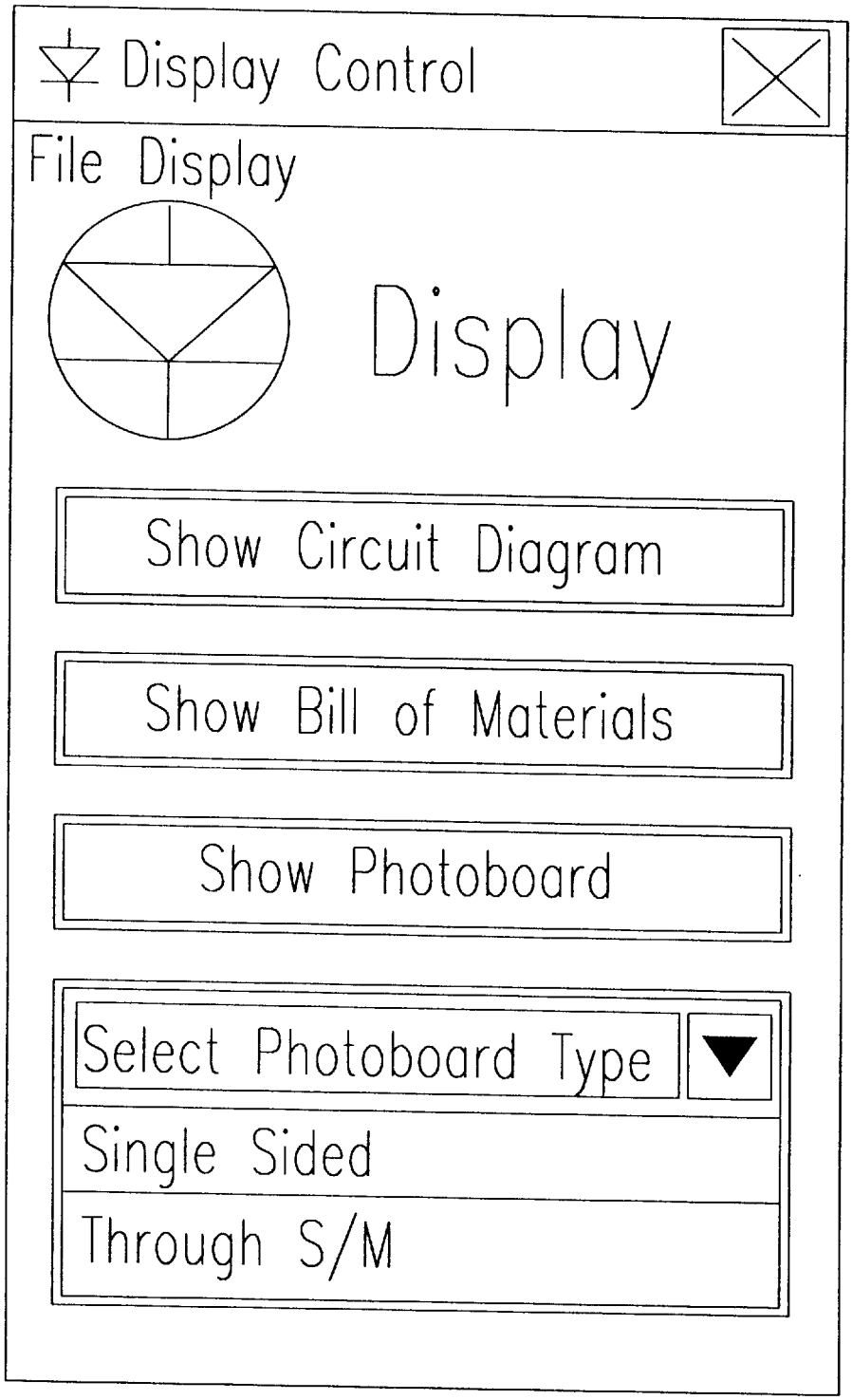
FIG. 17 is a display control screen of the computer program of the present invention.
Figure 18:
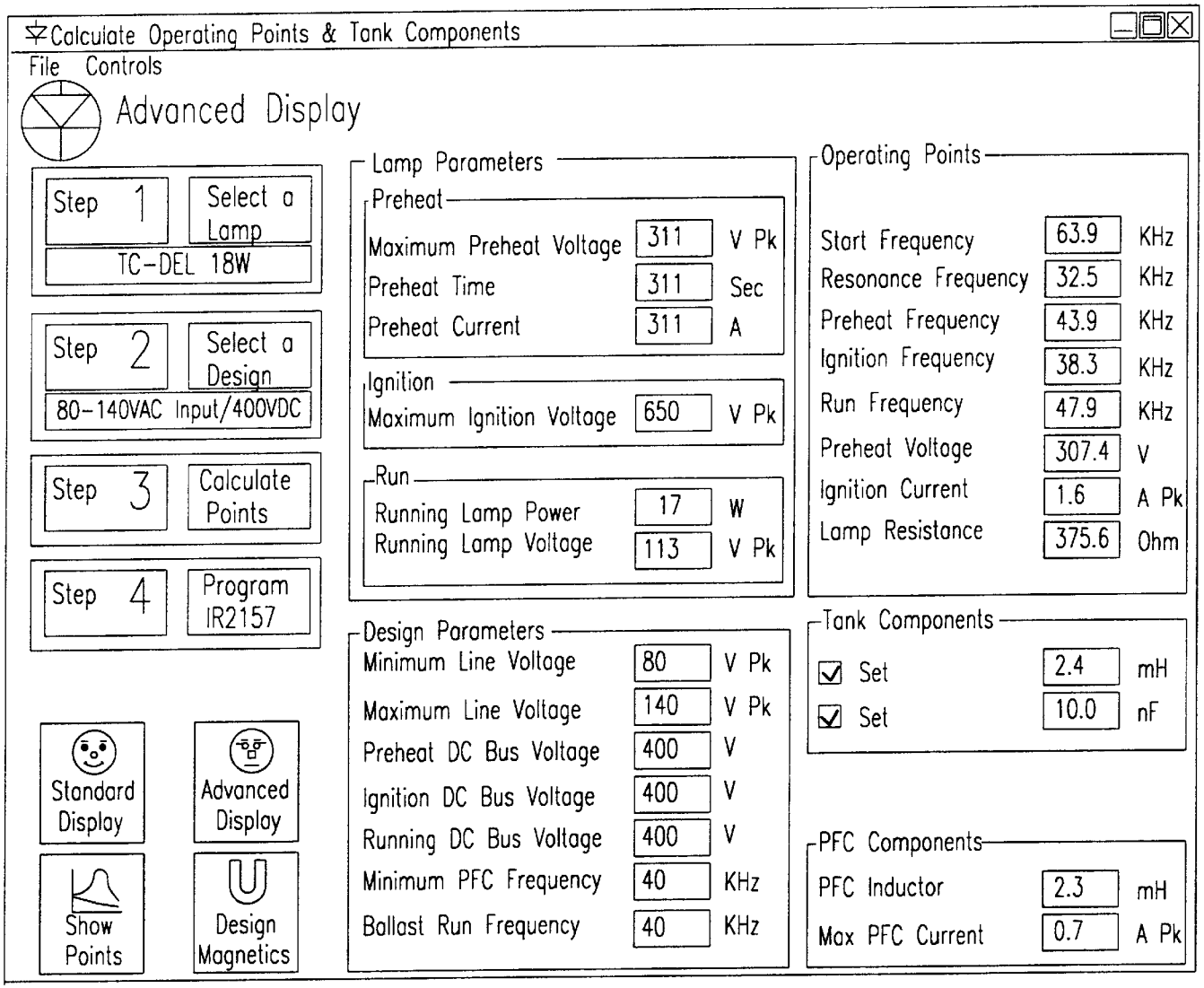
FIG. 18 is an advanced display screen of the computer program of the present invention.
Figure 19:
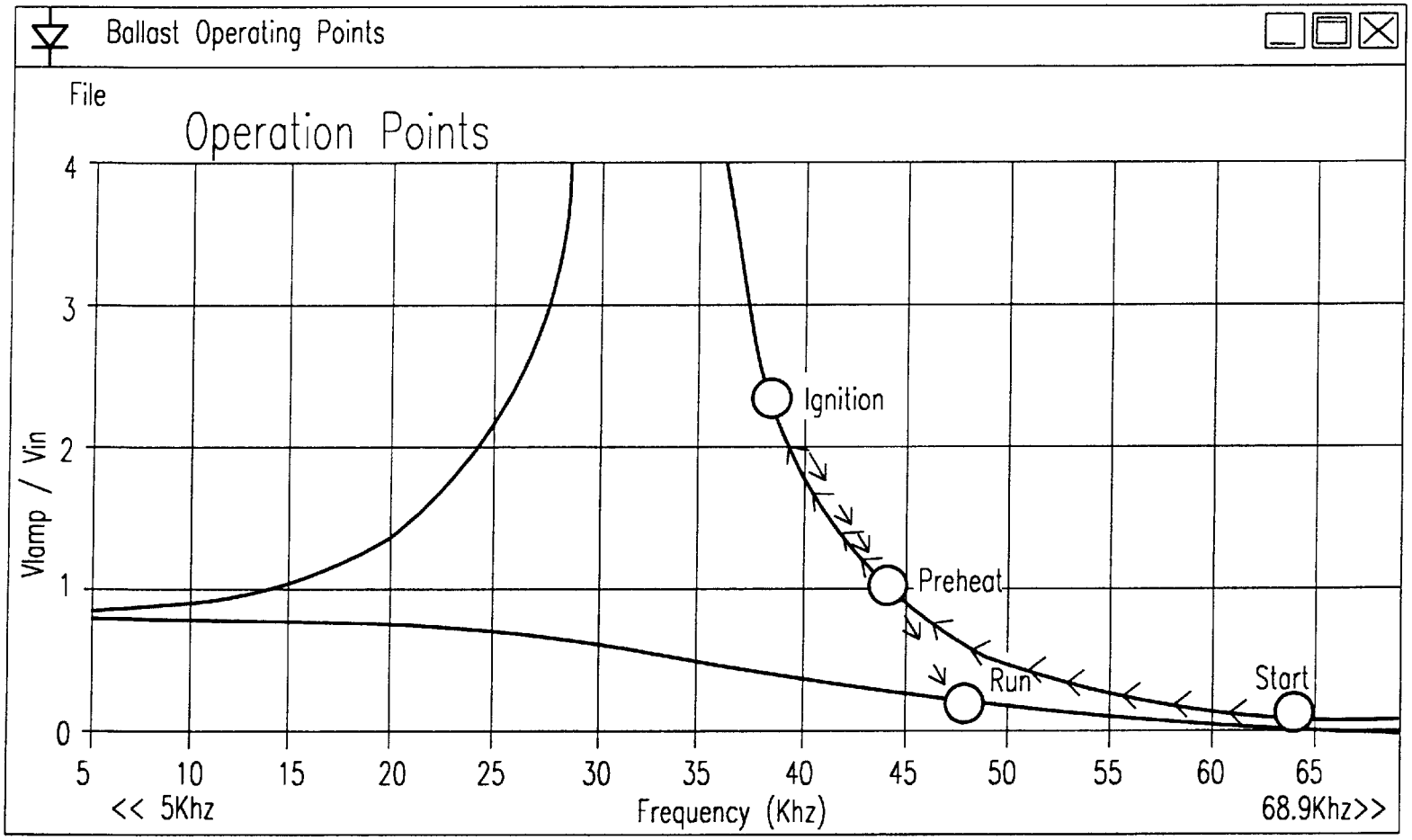
FIG. 19 is a component calculator screen of the computer program of the present invention.
Figure 20:
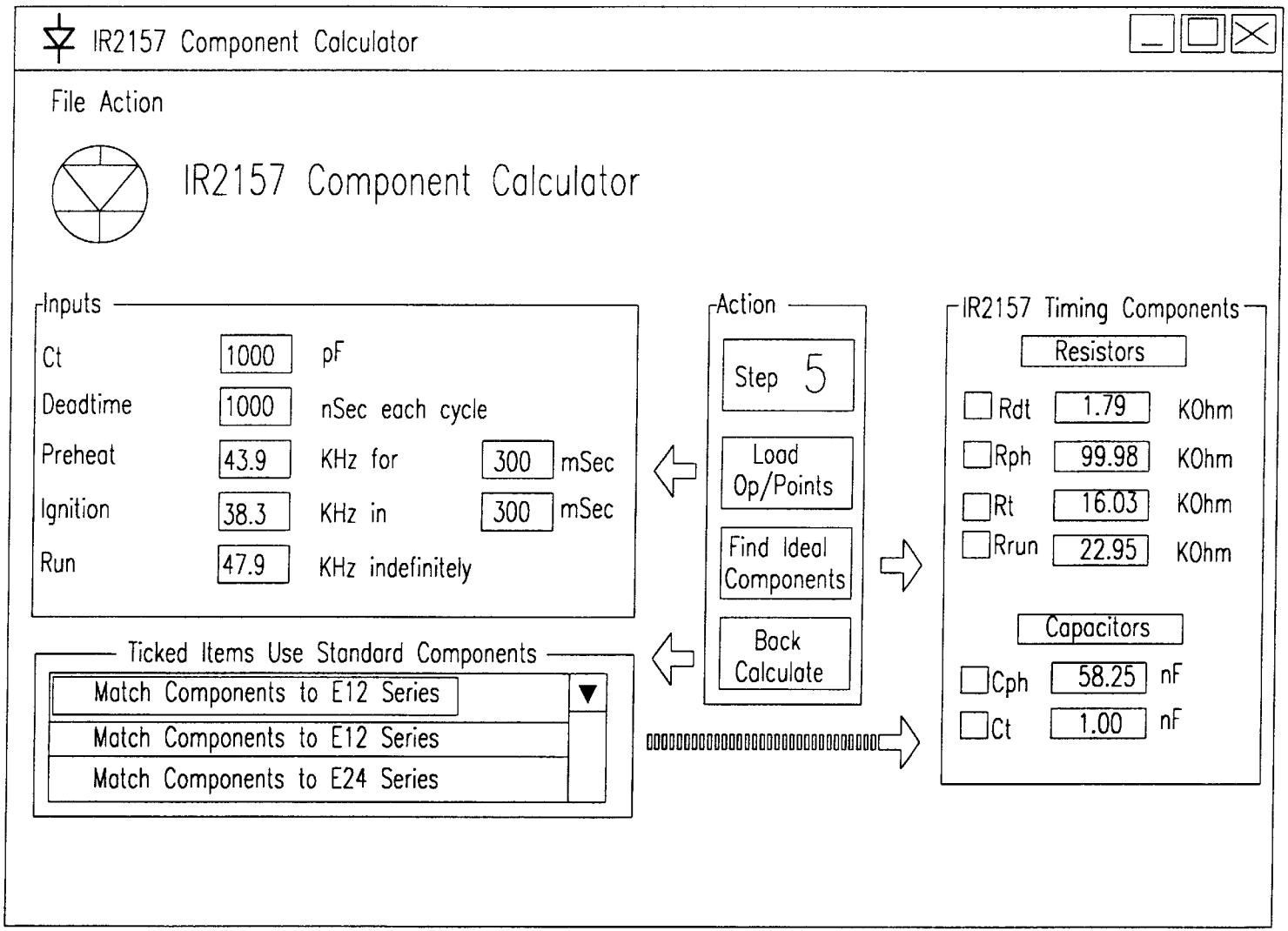
FIG. 20 is a ballast operating points display screen generated by the computer program of the present invention.

After the type of ballast has been selected, the program returns to the standard screen 20 (FIG. 12). Having selected the lamp and the type of ballast, the user then implements ballast design. Based on an optimal ballast design generated by the computer, the program produces a bill of materials (FIG. 15) for completing the ballast circuit diagram (FIG. 16).

Addition functionality can be provided, for example, by hyperlinks connecting over a network connection, such as the Internet, to manufacturers and suppliers of the components listed on the bill of materials for on-line ordering or informational purposes, or to an inventory or storage facility of an automated manufacturing facility. A display control screen (FIG. 17) allows the user to access other program features such as a photoboard design generator.

Further refinement or adjustment of the design can be achieved using functions provided by an advanced display screen 40. For example, operating points of the ballast design can be calculated and displayed (Step 3). See FIG. 19. In addition, by engaging a program icon (Step 4), a component calculator screen 50 (FIG. 20) enables the user to establish operating points and find ideal components for the design. Rather than using the default minimum running frequency selected by the program, for example, the user can adjust the minimum running frequency.

Once the design has been established, manufacture of the ballast can be done manually, or the design information can be transferred to an automated facility for production of the ballast.

Although the present invention has been described in relation to particular embodiments thereof, many other variations and modifications and other uses will become apparent to those skilled in the art. Therefore, the invention is to be limited not by the specific disclosure, but only by the appended claims.

What is claimed is:

1. A method for designing the output stage of an electronic ballast for a fluorescent lamp, the output stage including a capacitor and an inductor, the method comprising the steps of:

specifying a plurality of parameters relating to the operation of the fluorescent lamp, including a running power, a running voltage, and a maximum preheating voltage for the lamp;

selecting a minimum running frequency for the lamp;

selecting an input voltage for the ballast;

calculating a value for the inductor of the output stage;

calculating a preheat frequency, an ignition frequency, a running frequency, a preheat voltage, and an ignition current; and calculating a value for the capacitor of the output stage, such that the preheat frequency is greater than the ignition frequency, the ignition frequency is greater than or equal to the running frequency, the preheat voltage is less than the maximum preheat voltage, and the difference between the preheat frequency and the ignition frequency is greater than about 5 kHz.

2. The method of claim 1, wherein the preheat frequency of the lamp is calculated in accordance with the equation:

$$f_{ph} = \frac{I_{ph}\sqrt{2}}{2\pi C V_{ph}} \quad \text{[Hz]}. \tag{1}$$

3. The method of claim 1, wherein the ignition frequency for a given ignition voltage is calculated in accordance with the equation:

$$f_{ign} = \frac{1}{2\pi}\sqrt{\frac{1+\frac{4}{\pi}V_{in}}{\frac{V_{ign}}{LC}}} \quad \text{[Hz]}. \tag{2}$$

4. The method of claim 1, wherein the lamp running frequency is calculated in accordance with the equation:

$$f_{run} = \frac{1}{2\pi}\sqrt{\frac{1}{LC} - 2\left(\frac{P_{run}}{CV_{run}^2}\right)^2 + \sqrt{\left[\frac{1}{LC} - 2\left(\frac{P_{run}}{CV_{run}^2}\right)^2\right]^2 - \frac{1-\left(\frac{4V_{in}}{V_{run}\pi}\right)^2}{L^2C^2}}}\ . \tag{3}$$

5. A method for designing the output stage of an electronic ballast for a fluorescent lamp using a computer, the output stage including a capacitor and an inductor, the method comprising the steps of:

inputting to the computer user parameters relating to the operation of the fluorescent lamp, including a running power, a running voltage, and a maximum preheating voltage for the lamp;

selecting a minimum running frequency for the lamp;

selecting an input voltage for the ballast;

calculating a value for the inductor of the output stage;

calculating a preheat frequency, an ignition frequency, a running frequency, a preheat voltage, and an ignition current; and calculating a value for the capacitor of the output stage, such that the preheat frequency is greater than the ignition frequency, the ignition frequency is greater than or equal to the running frequency, the preheat voltage is less than the maximum preheat voltage, and the difference between the preheat frequency and the ignition frequency is greater than about 5 kHz.

* * * * *